US006300552B1

(12) United States Patent
Sato

(10) Patent No.: US 6,300,552 B1
(45) Date of Patent: Oct. 9, 2001

(54) WAVEFORM DATA TIME EXPANDING AND COMPRESSING DEVICE

(75) Inventor: Hiroshi Sato, Shizuoka-ken (JP)

(73) Assignee: Kabushiki Kaisha Kawai Gakki Seisakusho, Hamatsu (JP)

( * ) Notice: Subject to any disclaimer, the term of this patent is extended or adjusted under 35 U.S.C. 154(b) by 0 days.

(21) Appl. No.: 09/803,897

(22) Filed: Mar. 13, 2001

(30) Foreign Application Priority Data

Mar. 31, 2000 (JP) ..... 12-096524

(51) Int. Cl.[7] ..... G10H 7/00

(52) U.S. Cl. ..... 84/604; 84/605; 84/622; 704/503

(58) Field of Search ..... 84/603–605, 659; 704/500–504

(56) References Cited

U.S. PATENT DOCUMENTS 5,160,798 * 11/1992 Morikawa et al. ..... 84/622 X
5,416,264 * 5/1995 Toda et al. ..... 84/605 X
6,169,240 * 1/2001 Suzuki ..... 84/605
6,169,241 * 1/2001 Shimizu ..... 84/605
6,207,885 * 3/2001 Nogami et al. ..... 84/605 X

FOREIGN PATENT DOCUMENTS 10-307587 11/1998 (JP) .

* cited by examiner

*Primary Examiner*—Jeffrey Donels
(74) *Attorney, Agent, or Firm*—Oblon, Spivak, McClelland, Maier & Neustadt, P.C.

(57) ABSTRACT

There is provided a waveform data time expanding and compressing device, which includes a waveform memory for storing data of a PCM waveform; a block address memory for storing addresses of respective blocks, the respective blocks having a length equal to a wavelength of a pitch as a trend of the PCM waveform or an integral multiple thereof; a parameter determining unit for determining an expansion and compression parameter; and a waveform reproducer for carrying out waveform reproduction by determining a reading number for waveform data in a certain block in response to the expansion and compression parameter, sequentially reading out the block addresses according to the determined reading number, and reading out the PCM waveform data based on the block

14 Claims, 11 Drawing Sheets

$R = 0.75$

WAVEFORM DATA TIME EXPANDING AND COMPRESSING DEVICE

CROSS-REFERENCE TO RELATED APPLICATIONS

The present application claims priority under 35 U.S.C. §119 to Japanese application number 2000-096524, filed Mar. 31, 2000, entitled "Waveform Data Time Expanding and Compressing Device".

BACKGROUND OF THE INVENTION

1. Field of the Invention

The present invention relates to a waveform data time expanding and compressing device.

2. Discussion of Background

Devices having a sound source (including devices with only a sound source), such as electronic musical instruments, store PCM waveform data with respect to several different musical intervals in order to prevent the storage capacity of a memory from becoming huge for memory of the waveform data of live musical instruments. When such devices reproduce a musical interval different from the stored musical intervals, the devices read out PCM waveform data by a pitch different from the original pitch for reproduction.

When PCM waveform data are read out by a pitch different from the original pitch, not only the pitch but also the sounding time changes. For example, it is assumed that a musical tone, which has a rise-time of 0.1 sec and an entire sounding time of 1 sec, exists at C4. When the musical tone is read out an octave lower by the pitch of C3, the rise-time is 0.2 sec and the entire sounding time is 2 sec. Conversely, when the musical tone is read out an octave higher by the pitch of C5, the rise-time is 0.05 sec and the entire sounding time is 0.5 sec.

The waveform of usual musical tones is composed of an initial rising part (a heading part or an attacking part), followed by a steady part (a sustaining part). Most musical tones pose features in the transition at their rising parts, which means that, when the time of the rising part significantly changes from the original one, an unnatural impression is given to a listener. In other words, when the rise-time significantly changes in a case wherein waveform data are read out by a pitch different from the original one as stated earlier, the reproduced musical tone is heard as an unnatural sound.

In order to solve this problem, it has been carried out that waveform data are divided into plural frames having a certain length (a fixed length whatever the waveform data are), that a divided frame is repeated with joints cross-faded for time expansion, and that a divided frame is eliminated with joints cross-faded for time compression.

Since the length of the divided frames is arbitrarily determined in this process, it has been frequently experienced that the repetition of a frame is heard (produces a jarring noise), or that the cross-fading generates phase interference to degrade the tone. This process has created a problem that producing a sound in real time is not appropriate since the load to be processed is great and since it takes much time to carry out the process.

The present invention is provided in consideration of these problems. It is an object of the present invention to provide a waveform data time expanding and compressing device capable of reproducing a natural sound without degrading the tone and giving an unnatural impression to a listener, and reproducing a musical tone in real time under time expansion or time compression.

The present invention provides a waveform data time expanding and compressing device comprising a waveform memory for storing data of a PCM waveform; a block address memory for storing addresses of respective blocks, the respective blocks having a length equal to a wavelength of a pitch as a trend of the PCM waveform or an integral multiple thereof; a parameter determining unit for determining an expansion and compression parameter; and a waveform reproducer for carrying out waveform reproduction the waveform by determining a reading number for waveform data in a certain block in response to the expansion and compression parameter, sequentially reading out the block addresses according to the determined reading number, and reading out the PCM waveform data based on the block addresses thus read out.

By the arrangement according to the present invention, the waveform reproduction is carried out by not only sequentially reading out waveform data having a certain length as one unit (one block) but also repeatedly reading out or thinning out waveform data as required to expand and compress the entire sounding time. Specifically, when the waveform data are read out with the pitch raised, a certain unit of the waveform data is repeatedly read out with respect to the rising part and its vicinities to expand the sounding time to make the sounding time closer to that of the original waveform data since the entire sounding time otherwise becomes shorter. Conversely, when the waveform data are read out with the pitch lowered, a certain unit of the waveform data is thinned out with respect to the rising part and its vicinities to compress the sounding time to make the sounding time closer to that of the original waveform data since the entire sounding time otherwise becomes longer. Even if the waveform data are read out with the pitch changed, a listener can have a natural impression by, in particular, making the sounding time of the rising part closer to that of the original waveform data.

The reason why the blocks of the waveform data to read out are determined to have a length equal to a wavelength of a pitch as a trend of the PCM waveform or an integral multiple thereof is that the respective blocks are required to be coupled as a continuous waveform even at the junctions since the respective units (blocks) to read out are finally coupled to produce a waveform. The reason why the blocks of the waveform data to read out are determined based on the wavelength of the pitch as the trend of the PCM waveform is that the wavelength of a keynote or a harmonic tone that determines a tone is set to be equal to the wavelength of the pitch as the trend to prevent the tone from degrading. If a harmonic tone of a PCM waveform has a greater amplitude and plays a greater role in determination of the sound rather than the keynote of the PCM waveform, the pitch of the harmonic tone may be determined as the pitch as the trend.

In detail, the respective blocks are determined to have a length equal to the wavelength of the pitch as the trend or an integral multiple thereof, the addresses in the respective blocks are stored, and the waveform data are read out in the respective block addresses (a certain block is repeatedly read out, or a specific block is thinned out).

The wavelength of the pitch as the trend of the PCM waveform may be found by an autocorrelation function as an example. Specifically, one reason why it is preferable to find the pitch wavelength by the autocorrelation function is that when a waveform is shifted to establish correlation, it is easy to extract the pitch as the trend since the point that is shifted by the pitch wavelength as the trend has the highest correlation value due to interference. There is another reason that it is not necessary to consider a sampling frequency when the finding is carried out by the autocorrelation function. The finding by the autocorrelation function is effective when a keynote has a low level and is subjected to a vibrato as in, particularly, PCM waveforms.

It is preferable that the respective blocks to read out have a length between zero-cross points. The reason is that when the respective blocks are repeatedly read out or thinned out, the junctions become smoother, and an unnatural impression is eliminated as the junctions are closer to zero-cross points.

In the specification, the phase "zero-cross points" are ones (e.g., Point 11) that has an amplitude value of not greater than zero at the current sampling point and is followed by the next sampling point having a positive amplitude value (Point 12) as shown in FIG. 2 explained later on. The reason is to make phase matching easy by determining only zero-crossing from negative to positive as the zero-cross points.

In addition, the expansion and compression parameter is set to determine the reading number for waveform data accordingly. The reason is that when the waveform data are read out with the pitch raised, the entire sounding time becomes shorter, and conversely when the waveform data are read out with the pitch lowered, the entire sounding time becomes longer, and that in order to make the shortened or lengthened sounding time closer to the original one, when the waveform data are read out with the pitch raised, a certain unit of the waveform data is repeatedly read out with respect to the rising part and its vicinities to expand the sounding time, and conversely when the waveform data are read out with the pitch lowered, a certain unit of the waveform data is thinned out with respect to the rising part and its vicinities to compress the sounding time, which have been stated earlier. To accomplish this, the expansion and compression parameter is set to determine the reading number for waveform data accordingly, allowing at least one block to be repeatedly read out or thinned out of course, the block of the waveform data to be read out is determined based on the pitch wavelength (or an integral multiple thereof) as the trend of the PCM waveform as stated earlier. Even if the waveform data are read out with the pitch changed, a listener can have a natural impression by, in particular, making the sounding time of the rising part closer to that of the original waveform data.

The determination of the reading number for the waveform data based on the determined expansion and compression parameter may be carried out by making accumulation of the expansion and compression parameter in every reading of the addresses, setting the reading number at an integral part of an accumulation value given by the accumulation, setting the integral part at 0 after determination of the reading number, and repeating the accumulation, as will be explained with reference to the embodiment stated later. However, the determination of the reading number for the waveform data is not limited to this method. If this method is employed, the expansion and compression parameter is determined so that the parameter is 1 for reproducing the PCM waveform as it is, the parameter is greater than 1 for reproducing the PCM waveform by a higher frequency, and the parameter is less than 1 for reproducing the PCM waveform by a lower frequency.

When a PCM waveform is read out by a pitch greatly different from the original pitch, the formant is significantly shifted, and a listener may have an unnatural impression. It is known that the formant is not shifted even if a person speaks with the pitch changed. The present invention also provides an arrangement capable of preventing formant from shifting even when a PCM waveform is read out by a pitch different from that of the original waveform as stated earlier. Specifically, the present invention provides a waveform data time expanding and compressing device comprising a formant component memory for storing a formant component of data of an original PCM waveform; a waveform memory for storing the PCM waveform data with the formant component removed; a block address memory for storing addresses of respective blocks, the respective blocks having a length equal to a wavelength of a pitch as a trend of the PCM waveform or an integral multiple thereof; a parameter determining unit for determining an expansion and compression parameter; a waveform reproducer carrying out waveform for reproduction by determining a reading number for waveform data in a certain block in response to the expansion and compression parameter, sequentially reading out the block addresses according to the determined reading number, and reading out the PCM waveform data based on the block addresses thus read out; and a formant adder for adding a corresponding formant to the reproduced waveform.

After the formant component of the original PCM waveform data is stored and the process stated earlier is carried out, the corresponding formant is added to the reproduced waveform. As a result, even if the pitch changes, a listener can have a natural impression since the formant is prevented from shifting.

When musical intervals, which are assigned to keys in, e.g., an electronic keyboard instrument, are reproduced, the expansion and compression parameter may be modified as to match with the musical intervals of the respective keys. In detail, the expansion and compression parameter set at the parameter determining unit may be modified by a key scale parameter.

Even if this arrangement is applied, noise could cause in repeated sections or junctions in a waveform when the wavelength of the pitch as the trend of the waveform is not an integral word (when a sampling frequency is 44100 Hz and a pitch is 438.8 Hz, the wavelength has 100.5 words, which is not an integral word). This is because there is a jump in the amplitude value at the repeated sections or the junctions in the waveform.

In such a case, cross-fading may be carried out at the repeated sections on the junctions to make the entire portions of the reproduced waveform merge smoothly. Specifically, for reading out the waveform data at the waveform reproducer, sample data of certain points following a zero cross-point are inputted into a buffer after completion of reading out the waveform data in a block, and sample data of first certain points in a subsequent block and the sample data in the buffer are cross-faded in reading out the waveform in the latter block.

As explained, the waveform data time expanding and compressing device according to the present invention can provide superior advantages in that when PCM waveform data are read out by a pitch different from the original pitch, a natural sound can be reproduced without degrading its tone and giving an unnatural impression to a listener, and that the time expanding and compressing reproduction of a musical sound can be carried out even in real time.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

Referring to FIGS. 1 through 10, the preparatory stage for a waveform will be explained first. In FIGS. 1 through 10 are shown illustrations to explain the principle of a waveform data time expanding and compressing method, which is carried out when reading a PCM waveform by a waveform date time expanding and compressing device according to the present invention.

Figure 1:
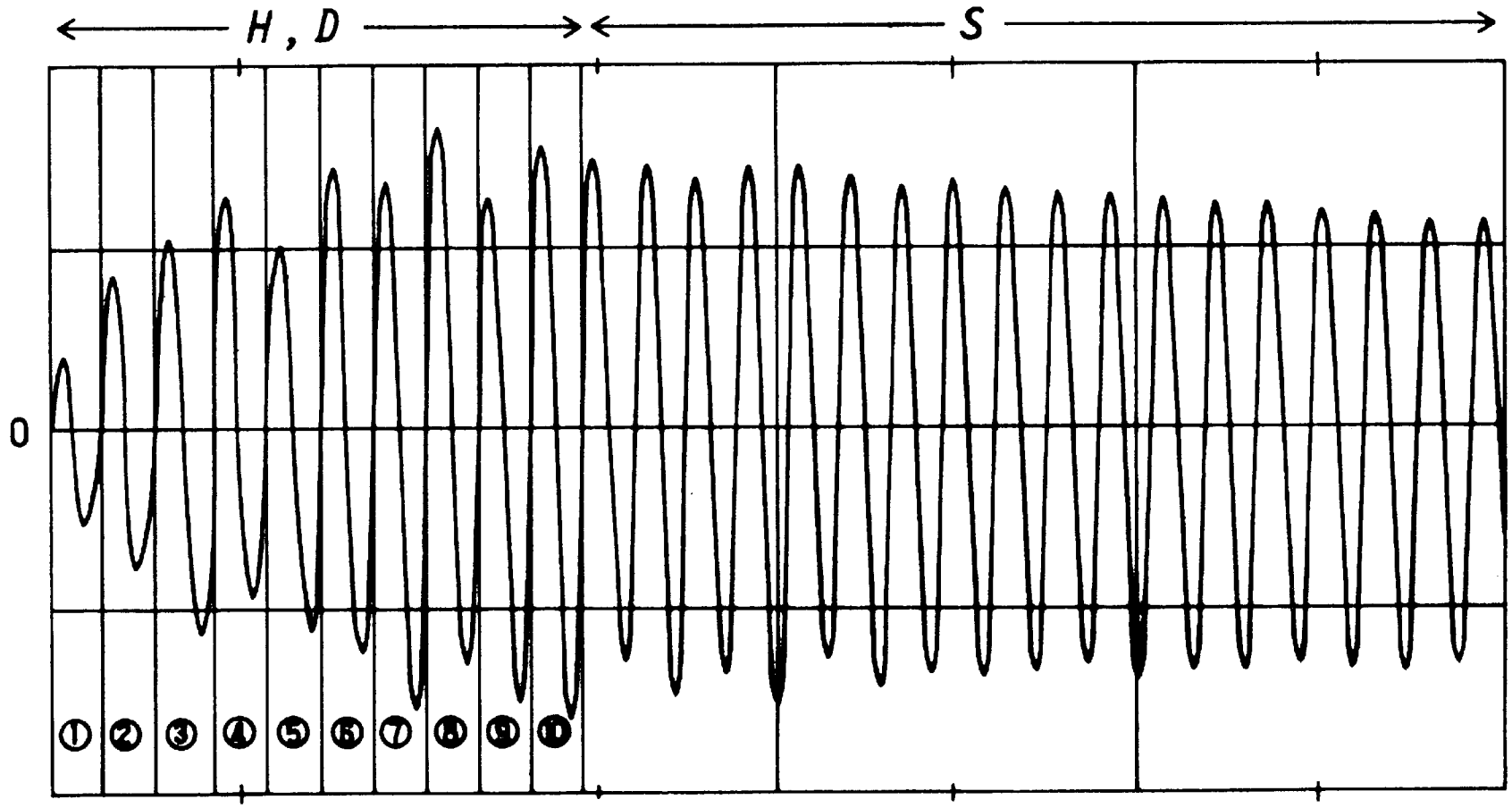
FIG. 1 is a waveform chart of an original PCM waveform of a live musical instrument of a human voice, which is subjected to sampling and is stored in a waveform memory.

In FIG. 1 is shown an original PCM waveform, which is the sound of a live musical instrument or a human voice stored in a waveform memory 101 of a waveform editor described later on after sampling the sound, and which is required to be dealt with in accordance with the present invention. Sections ⑥–⑩ shown in this figure are an attacking part (a heading part) H and a decay part D of the PCM waveform. These sections are followed by a sustaining part S.

A pitch as the trend (a reference pitch) of the PCM waveform is extracted by an autocorrelation function, and the extracted reference pitch is stored in a reference pitch memory 102.

A first zero-cross-point in the PCM waveform is found, and its address is stored in a block address memory 103 described later on.

Another zero-cross-point that is apart from and behind the first zero-cross-point by a distance closest to the wavelength of the reference pitch is found, and its address is stored in the block address memory 103.

Figure 2:
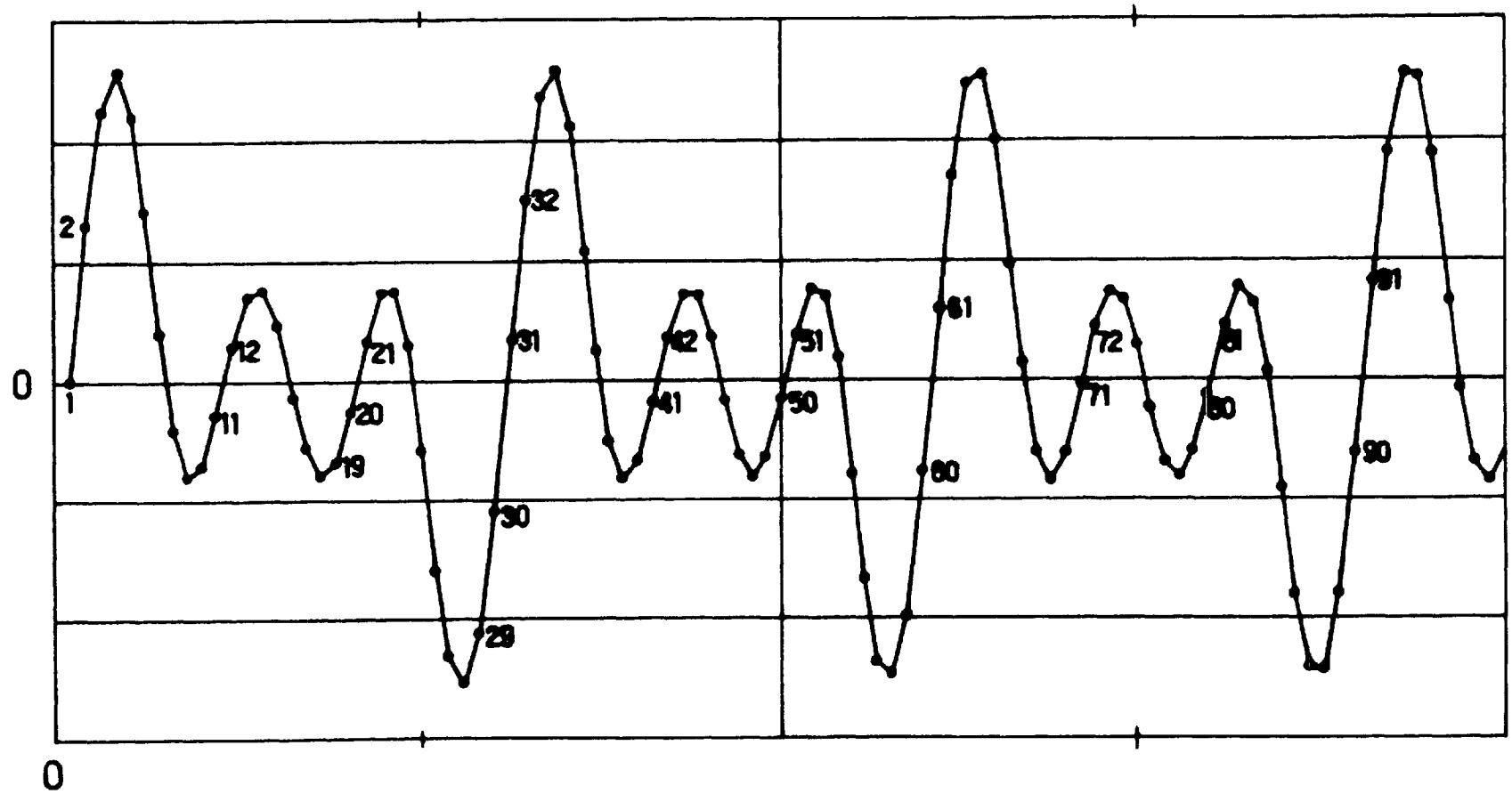
FIG. 2 is a waveform chart of the original PCM waveform, which is subjected to sampling and is stored in the waveform memory.

For example, when the PCM waveform shown in FIG. 2 is sampled at a sampling frequency Fs of 30000 Hz, and when the frequency F of the reference pitch is extracted as 1010 Hz, the wavelength L can be found according to the following equation 1;

$$L=30000/1010=29\cdot70297 \qquad \text{Equation 1}$$

The zero-cross-points stated just above are points, which have an amplitude value of not greater than 0 at the current sampling point, followed by the next sampling point having a positive amplitude value. In the case of FIG. 2, the zero-cross-points are at 1 (Point 1), 11, 20, 30, 41, 50, 60, 71, 80 and 90.

On the other hand, the zero-cross-points that are extracted in accordance with the present invention can be found as follows. The first zero-cross-point is the Point 1. Next, when zero-cross-points in a range of 15 samples before and after Point 31, which is apart from the first zero-cross-point by the wavelength of the reference pitch (30 samples), are taken into account, Points 20, 30 and 41 are extracted. The distances between the Point 1 and the other Points are 19, 29 and 40, respectively. The Point 30 is determined as a zero-cross-point to be found since the Point 30 has a length of 29, which is closest to the wavelength of 30. Point 60, Point 90 and other Points are likewise extracted.

This process is repeated up to the final part of the original PCM waveform. The addresses of the respective blocks are stored in the block address memory in order from the top of the PCM waveform.

Figure 3:
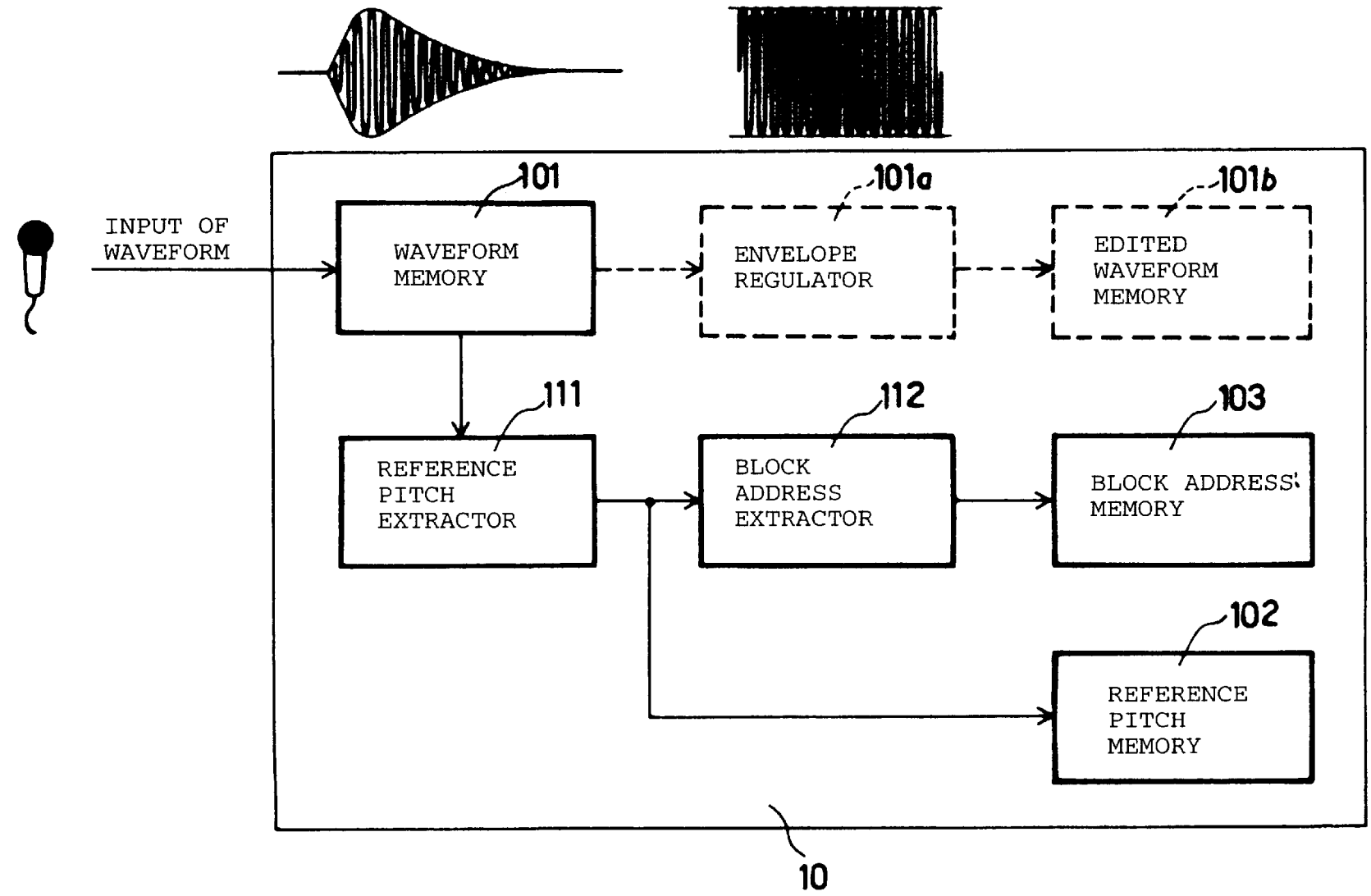
FIG. 3 is a functional block diagram of a waveform editor.

In FIG. 3 is shown a functional block diagram of the waveform editor 10, which performs the editing process stated earlier. As shown in this figure, the sound of a live musical instrument or a human voice is captured and stored as an original PCM waveform in the waveform memory 101. The waveform editor 10 is provided by reading and executing a specific program on an electronic circuit or a personal computer. The waveform editor 10 mainly comprises an arithmetic and control circuit, such as a CPU, a memory circuit, such as a RAM, a ROM and a hard disk, and the program read into the CPU and executed therein to function the arithmetic and control circuit and the memory circuit as the waveform editor.

The waveform data may be stored in an edited waveform memory 101*b* in such a form that the power envelope is made substantially constant by an envelope regulator 101*a*.

The reference pitch of the waveform data is found by the autocorrelation function at a reference pitch extractor 111, and the reference pitch thus found is stored in the reference pitch memory 102.

Based on the reference pitch thus found, a block address is extracted by a block address extractor 112 and stored in the block address memory 103.

Figure 4:
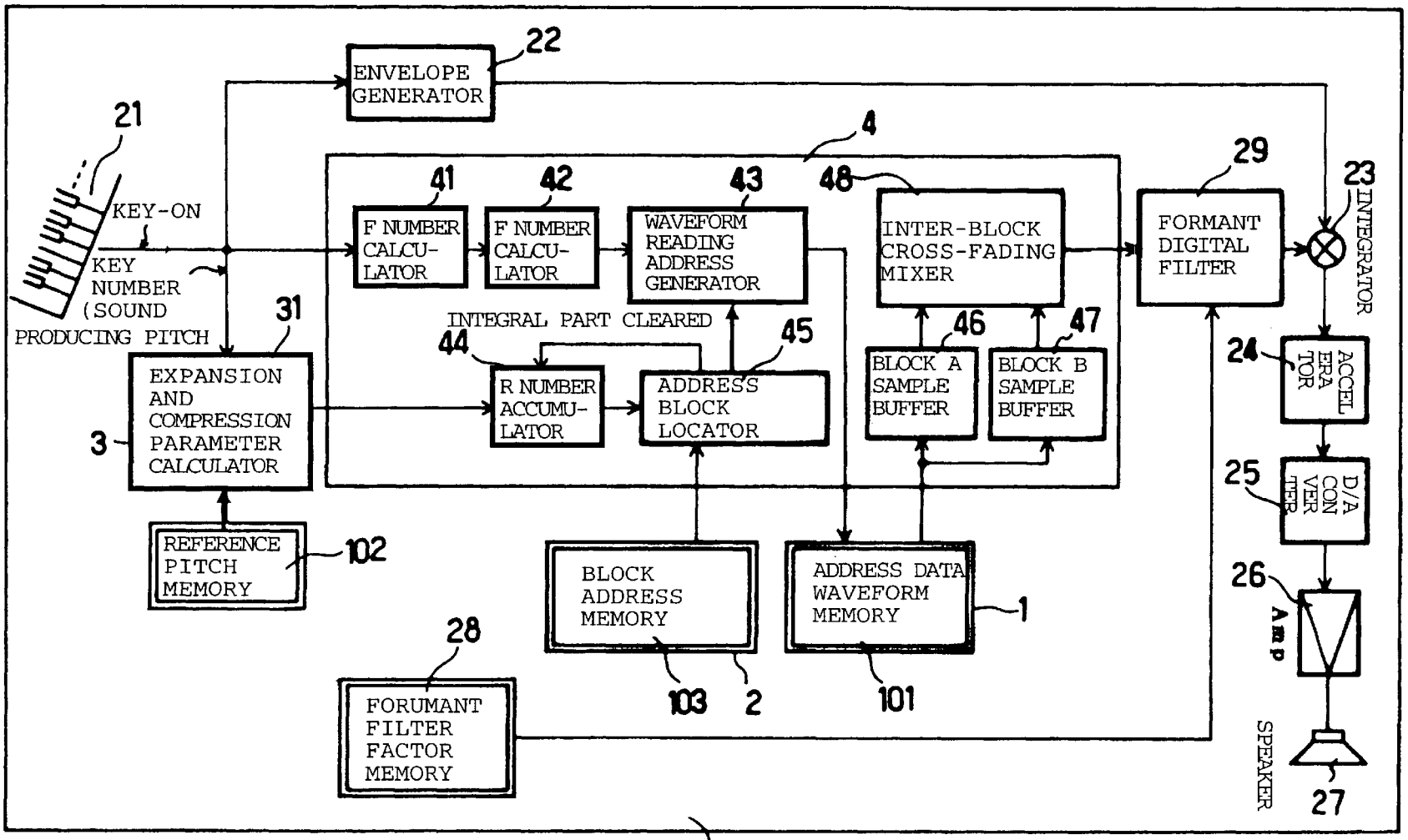
FIG. 4 is a functional block diagram of an electronic keyboard instrument, to which the waveform data time expansion and compression device according to an embodiment of the present invention is applied.

In FIG. 4 is shown a functional block diagram of an electronic keyboard instrument, to which the waveform data time expanding and compressing device according to an embodiment of the present invention is applied. The waveform data, the reference pitch and the block addresses, which have been extracted by the waveform editor 10, are duplicated and are stored in a waveform memory 101, a reference pitch memory 102 and a block address memory 103 in the electronic keyboard instrument.

The device according to the present invention includes a waveform storage 1 comprising the waveform memory 101, a block address storage 2 comprising the block address memory 103, a parameter determining unit 3 comprising an expansion and compression parameter calculator 31 stated later on, and a waveform regenerator 4 comprising an F number calculator 41, an F number accumulator 42, a waveform reading address generator 43, an R number accumulator 44, a block address locator 45, a block A sample buffer 46, a block B sample buffer 47 and an inter-block cross-fading mixing unit 48 stated later on. Such an arrangement is provided by reading and executing a specific program on an electronic circuit. The arrangement mainly comprises an arithmetic and control circuit, such as a CPU, a memory circuit, such as a RAM and a ROM, and the program read into the CPU and executed therein to function the arithmetic and control circuit and the memory circuit as the waveform data time expansion and compression device.

The electronic keyboard instrument 20 further includes a keyboard 21, an envelope generator 22, an integrator 23, an accumulator 24 for concurrent production of sounds from plural channels, a D/A converter 25, an amplifier 26 and a speaker 27.

The electronic keyboard instrument 20 has a sampling function so that the waveform memory 101 has such an arrangement to sample a human voice or another sound and to prevent the formant of the human voice or the other sound from being modified in reproduction of the waveform. In detail, when a human voice or another sound is sampled, its formant component is extracted as a formant factor by the cepstrum analysis, and the extracted formant factor is stored in a formant filter factor memory 28. When the formant factor is extracted, the original waveform is multiplied by a filter having the reverse characteristics of the extracted formant factor to remove the formant component, and the one with the formant component removed is stored in the waveform memory 101. The electronic keyboard has an output side provided with a formant digital filter 29, which serves to multiply a reproduced waveform by the formant factor so as to return the reproduced waveform data to the original PCM waveform data without the formant shifted. Explanation of the functions of the arrangement will be made later on.

In the electronic keyboard instrument 20 shown in FIG. 4, when it is detected that a key turns on in the keyboard 21, the key number (sound-producing pitch) corresponding the key is inputted into the envelope generator 22, the F number calculator 41 and the expansion and compression parameter calculator 31.

When the key number is inputted into the F number calculator 41, the F number corresponding to the key number is calculated, the F number is subsequently inputted into the F number accumulator 42 and then into the waveform reading address generator 43. The F numbers thus found are accumulated in the F number accumulator 42, and the F number accumulation value is inputted into the waveform reading address generator 43 on each accumulation. Normally, a waveform reading address is produced based on the F number accumulation value. Thus, relevant PCM waveform data are read from the waveform memory 101.

The expansion and compression parameter calculator 31 calculates and sets an expansion and compression parameter R (real number, R<1: compression, R>1: expansion) based on the sound-producing pitch of the inputted key number and the relevant reference pitch stored in the reference pitch memory 102. Specifically, the expansion and compression parameter calculator 31 has the reference pitch (KeyOrg) of the original PCM waveform, the sound-producing pitch (Key) of the key number and a key scale depth (Depth, When Depth=1, no change is made, and when Depth<1, loosing is made.) inputted as key scale parameters thereinto, and the expansion and compression parameter R is found by the following equation 2:

$$R=R'\cdot 2^{[(\text{Key}-\text{KeyOrg})\times\text{Depth}/12]} \qquad \text{Equation 2}$$

R': Value set or manipulated by a user (the value defaults to one, and respective tones have different values.)

The expansion and compression parameter R thus found is read out to the R number accumulator 44 and is written on a buffer (not shown) once. However, in order that the expansion and compression parameter is read out as it is in the first one cycle, when R<1, the expansion and compression parameter R is written on the buffer B, and when R>1, 0 is written on the buffer B.

The block address locator 45 reads out the first block address from the block address memory 103, and the first block address thus read is given to the waveform reading address generator 43. The waveform reading address generator 43 reads out the PCM waveform up to the address thus read, and the PCM waveform thus read is written on the block A sample buffer 46. The block address is written on an address buffer (not shown) of the block address locator 45.

The envelope that is given by the envelope generator 22 is added to the PCM waveform thus read at the integrator 23, the accumulator 24 performs accumulation by the number of sounds concurrently produced, and the PCM waveform is outputted the D/A converter 25, the amplifier 26 and the speaker 27.

The integral part of the first parameter in the buffer B of the R number accumulator 44 is cleared or is made to zero (if the buffer B is 1.5, the buffer B is made to 0.5). Then, the next expansion and compression parameter R is read out to the buffer B of the R number accumulator 44, the next expansion and compression parameter R is added to the previous expansion and compression parameter R at the R number accumulator 44, and the value thus found is written on the buffer B of the R number accumulator 44.

The value of the integral parts of the parameters R that have been written on the buffer B is outputted as a reading number by the R number accumulator 44. The block address locator 45 outputs the block addresses stored in the address buffer to the waveform reading address generator 43 by the reading number. Or, block addresses are sequentially read out from the block address memory 103, or block addresses are read out being shifted forward by a certain number (if the integral part is zero, reading is not made), and the block addresses thus read are outputted to the waveform reading address generator 43.

The waveform reading address generator 43 reads out the PCM waveform up to the last address thus given, and the PCM waveform is written on the block A sample buffer 46.

The envelope that is given by the envelope generator 22 is added to the PCM waveform thus read at the integrator 23, the accumulator 24 accumulates the PCM waveform by the number of sounds concurrently produced, and the PCM waveform is outputted through the D/A converter 25, the amplifier 26 and the speaker 27.

Figure 5:
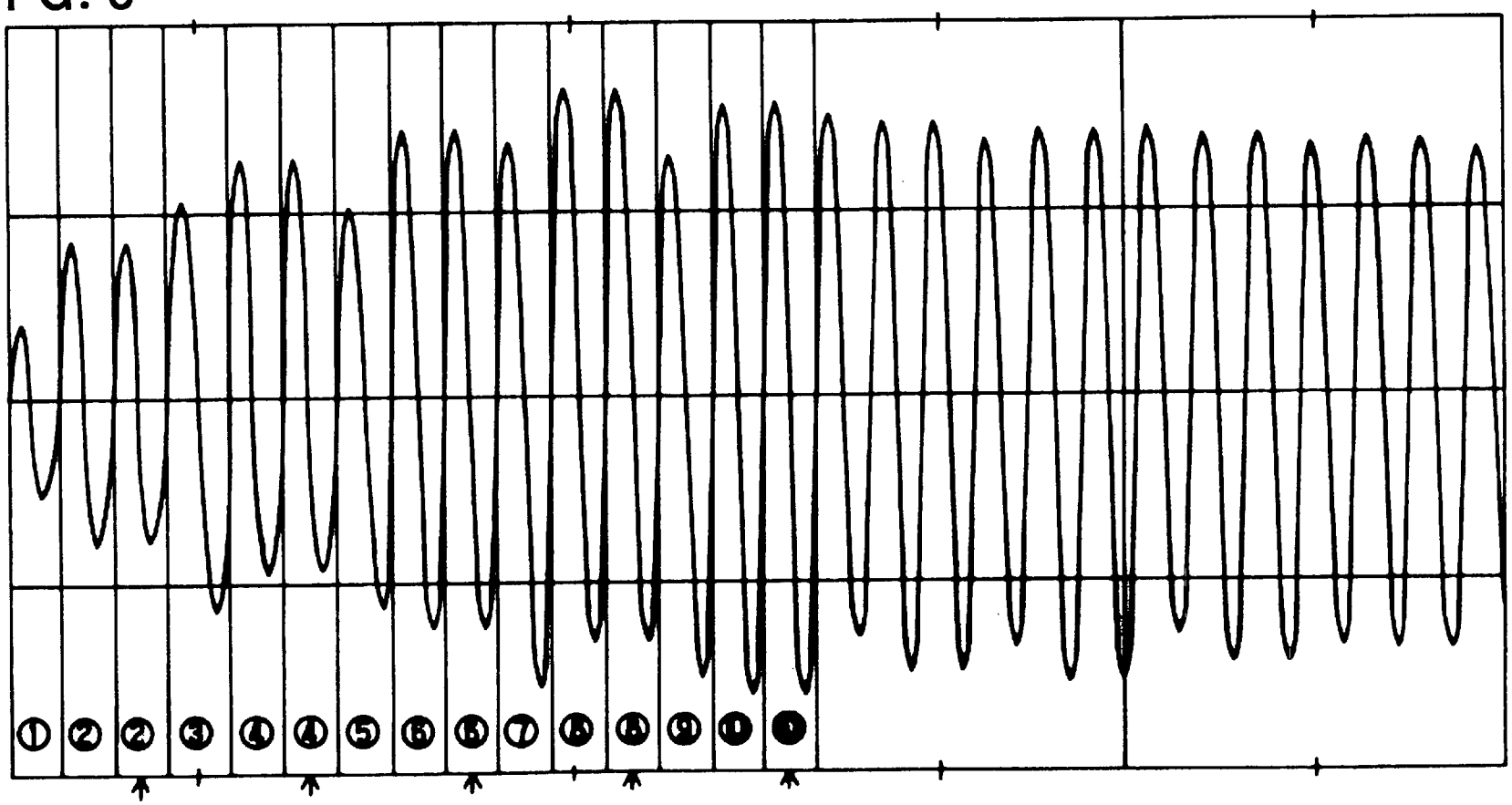
FIG. 5 is a waveform chart of a PCM waveform showing how to deal with the waveform of FIG. 1 when the waveform is read out a half octave higher than the key number.
Figure 6:
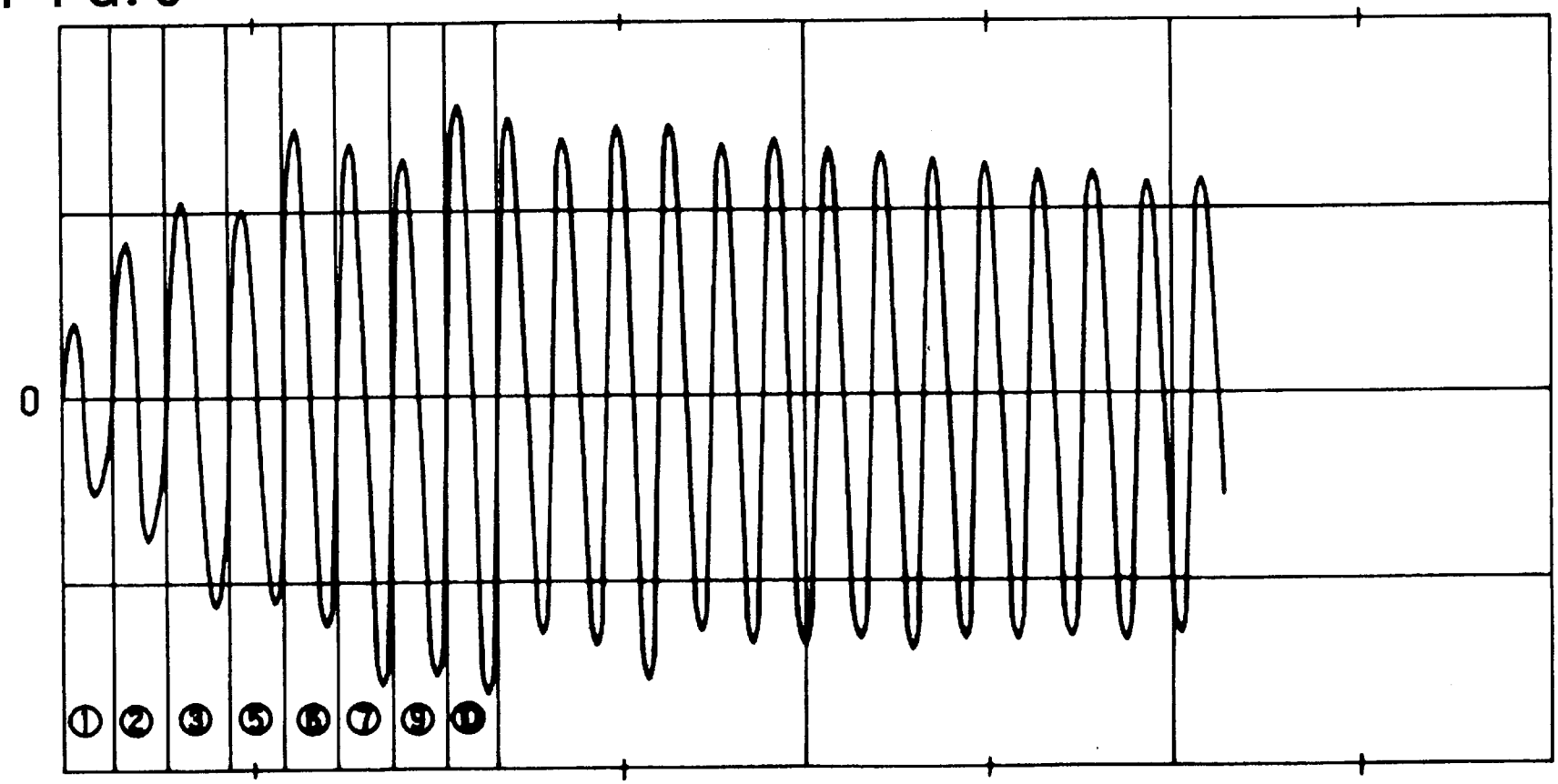
FIG. 6 is a waveform chart of a PCM waveform showing how to deal with the waveform of FIG. 1 when the waveform is read out three quarters of an octave lower than the key number.

Such processing is repeated to end. In FIG. 5 is shown how to process the waveform of FIG. 1 when the sound corresponding to the key number is reproduced a half octave higher. In this case, the expansion and compression parameter R is 1.5, and waveforms ($\hat{2}$, $\hat{4}$, $\hat{6}$, $\hat{8}$ and $\hat{10}$) are repeatedly read out every other block at the heading part H, extending the time length by about 1.5 times. In FIG. 6 is shown how to process the waveform of FIG. 1 when the sound corresponding to the key number is reproduced three quarters of an octave lower. In this case, the expansion and compression parameter R is 0.75, and waveforms ($\hat{4}$ and $\hat{8}$) in certain blocks are thinned out every fourth block in read-out at the heading part H, shortening the time length by about 0.75 times.

Figure 7:
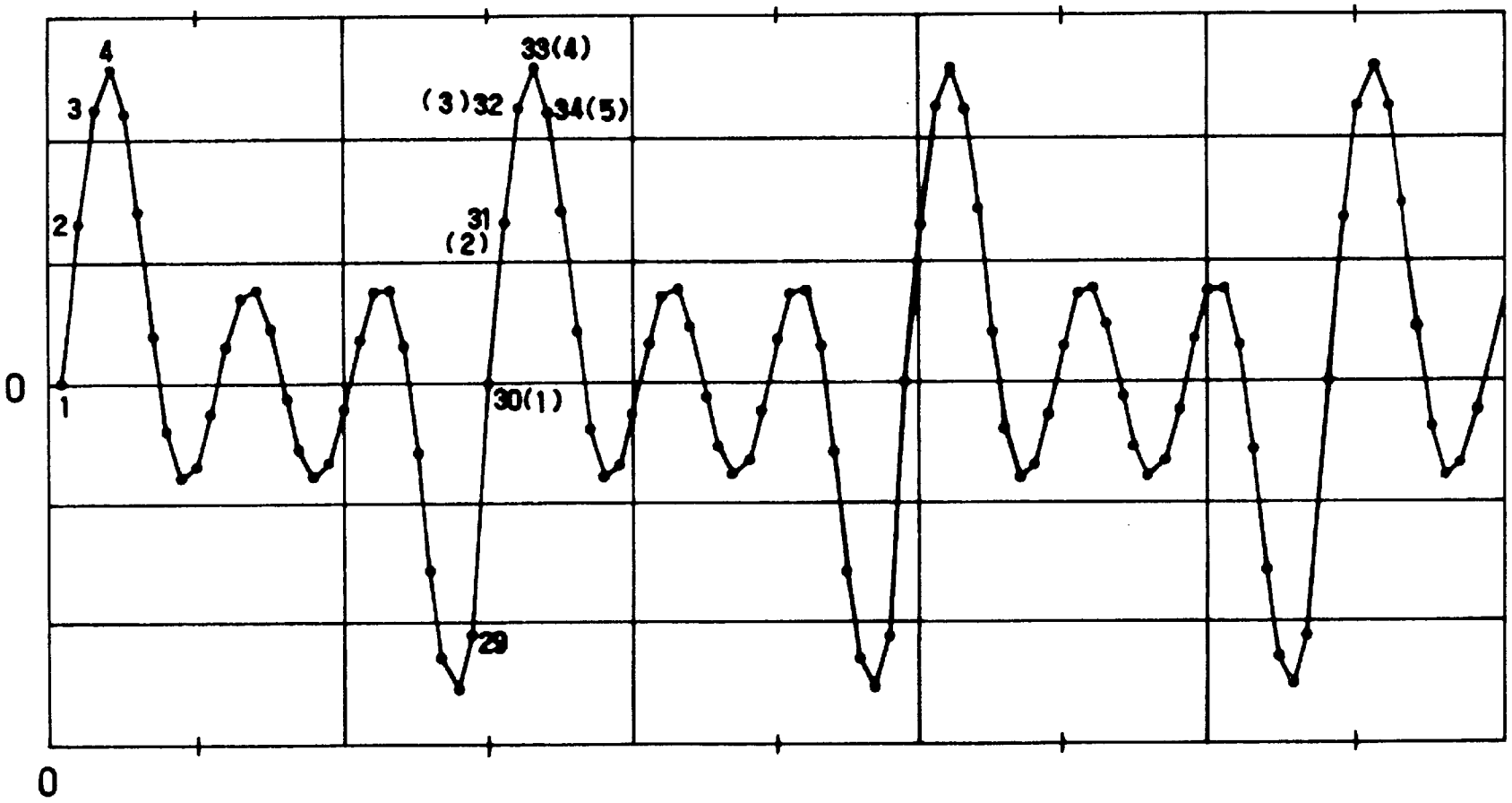
FIG. 7 is a waveform how amplitude values jump up when the waveform data of a certain block are repeatedly reproduced.
Figure 8:
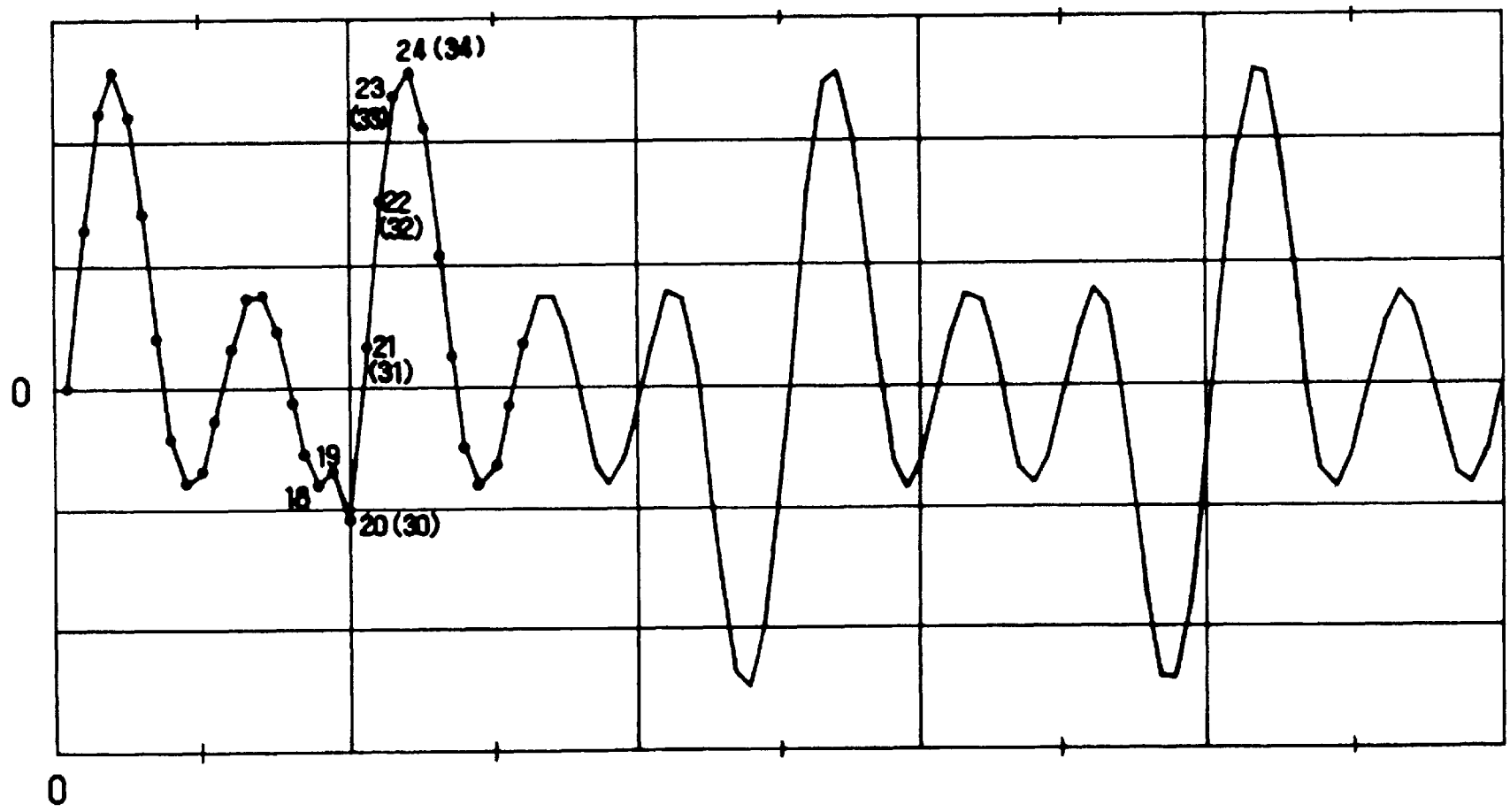
FIG. 8 is a waveform chart showing how discontinuity is produced when the waveform data of a certain block is thinned out in reproduction.

In the case of FIG. 2, when the 29 samples in the first cycle are repeated, the amplitude value jumps up between the Point 29 and the Point 30 as shown in FIG. 7, causing noise. On the other hand, when all zero-cross-points found in the case of FIG. 2 are determined as the zero-cross-point in every cycle (which means that the wavelength of one cycle is about 10 points), when the Point 11 is determined as the first zero-cross-point, and when the expansion and compression parameter R is set at 0.5, jumping up to the Point 30 is made after having reading out by the Point 19. In this case, since the amplitude value of the Point 30 is smaller than that of the Point 19, discontinuity is made as shown in FIG. 8, causing noise.

In order to cope with these problems, the present invention provides an arrangement to carry out a cross-fading process at junctions of adjoining blocks. Namely, when the waveform in a block is read out and is written on the block A sample buffer 46 during waveform reproduction, the sample data (Data B0, Data B1, Data B2) of the three points following the zero-cross-point in that block are put in the block B sample buffer 47, and when the waveform data in the next block are read out, the sample data (Data 0, Data 1, Data 2) of the first three points in the latter block and the sample data (Data B0, Data B1, Data B2) of the buffer 47 are cross-faded by the inter-block cross-fading mixer 48 as shown in the following equation 3, equation 4 and equation 5:

Data 0'=Data 0*0.3+Data *B*0*0.7

Data 0': Output from the inter-block cross-fading mixer 48

Equation 3

Data 1'=Data 1*0.5+Data *B*1*0.5

Data 1': Output from the inter-block cross-fading mixer 48

Equation 4

Data 2'=Data 2*0.7+Data *B*2*0.3

Data 2': Output from the inter-block cross-fading mixer 48

Equation 5

Figure 9:
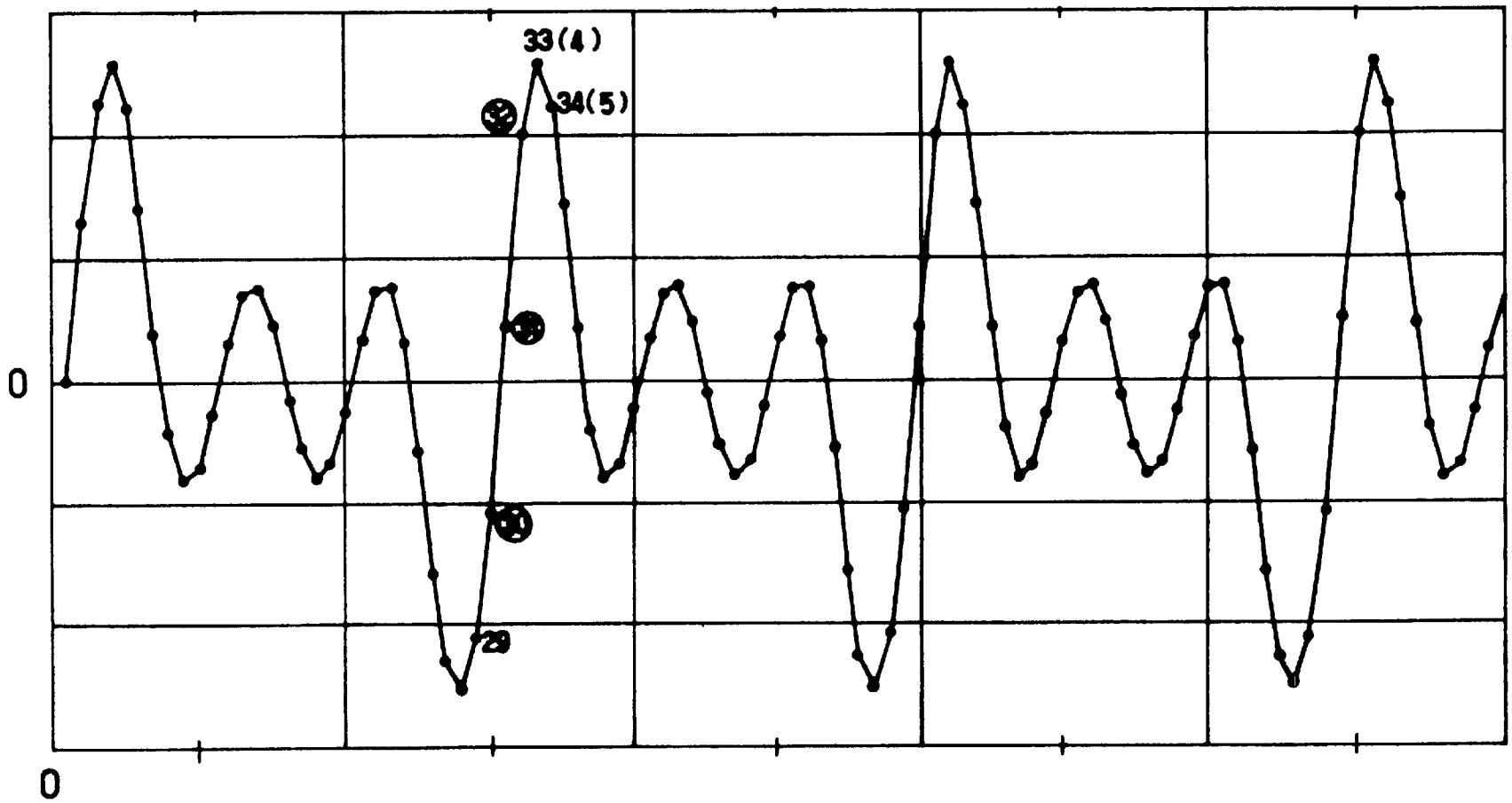
FIG. 9 is a waveform chart of a case wherein cross-fading prevents noise from causing since no jump is produced unlike the case of FIG. 7.

In FIG. 9 is shown an example of the case wherein the cross-fading process thus carried out prevents the noise as shown in FIG. 7 from causing (the Points 30, 31 and 32 in FIG. 2 are faded out, and the Points 1, 2 and 3 in FIG. 2 are faded in). It is shown that the cross-fading process equalizes the differences of the amplitudes in the section between the Point 29 and the Point 33 to make generation of noise difficult, while the amplitude value jumps up from the Point 29 onto the Point 30 in FIG. 7.

Figure 10:
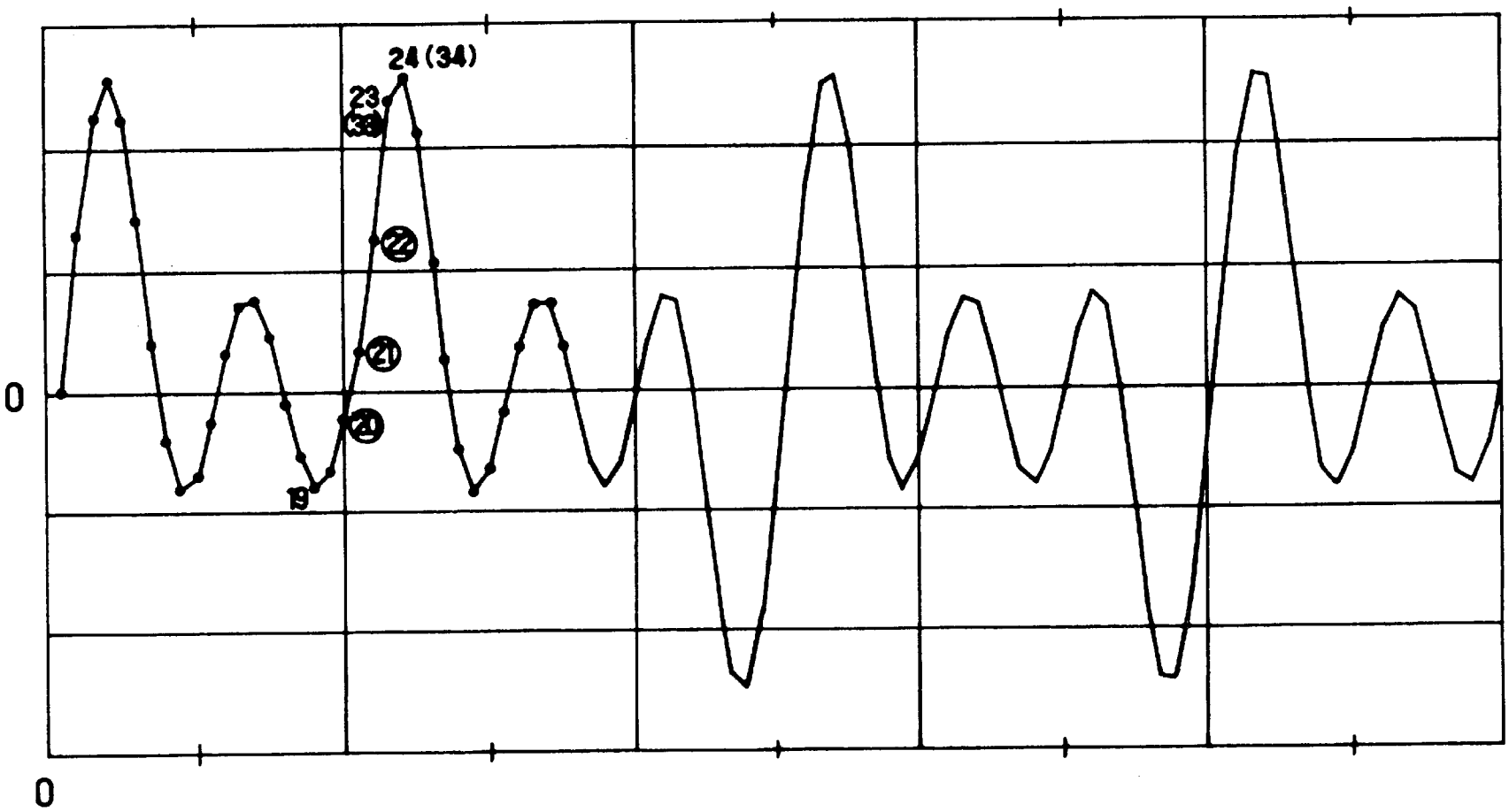
FIG. 10 is a waveform chart of a case wherein cross-fading prevents noise from causing since no discontinuity is produced unlike the case of FIG. 8.

In FIG. 10 is shown an example of the case wherein the cross-fading process thus carried out prevents the noise as shown in FIG. 8 from causing (the Points 20, 21 and 22 in FIG. 2 are faded out, and the Points 31, 32 and 33 in FIG. 2 are faded in). It is shown that the cross-fading process smoothly merges the section between the Point 19 and the Point 23 to make generation of noise difficult, while there is discontinuity between the Point 19 and the Point 21 in FIG. 8.

In accordance with the arrangement of the present invention, when a human voice or another sound is sampled for storing in the waveform memory 101, its formant component is extracted as a formant factor by the cepstrum analysis or another analysis, and the extracted formant factor is stored in the formant filter factor memory 28 as stated earlier. For reproduction of a waveform, the formant digital filter 29 multiplies the reproduced waveform by the formant component to return the reproduced waveform to the original PCM waveform data without the formant shifted.

When the formant factor is extracted, the original waveform is multiplied by a filter having the reverse characteristics of the extracted formant factor to remove the formant component, and the one with the formant component removed is stored in the waveform memory 101.

Figure 11:
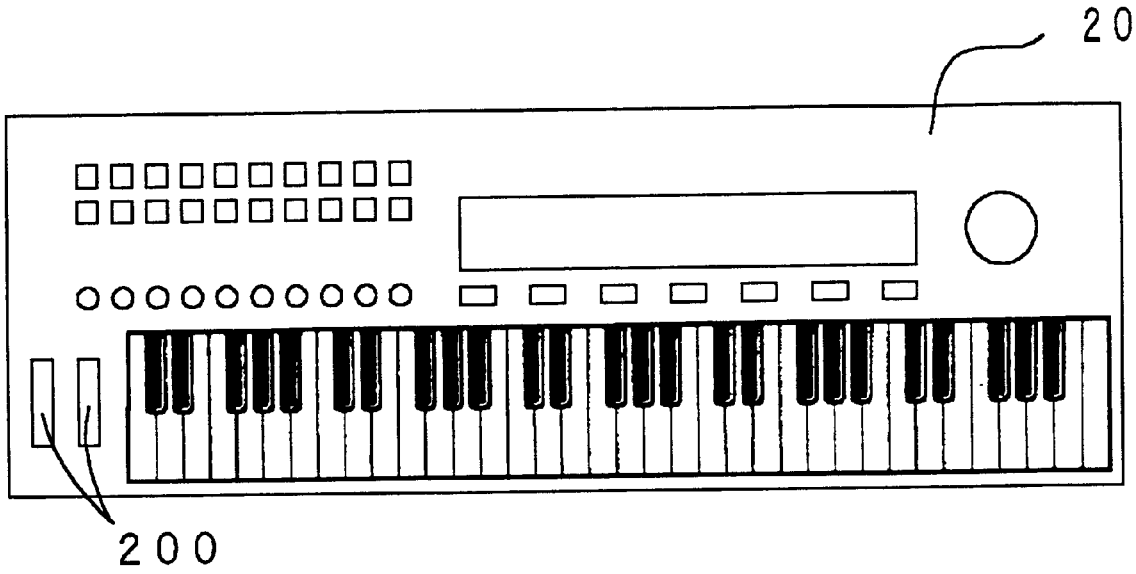
FIG. 11 is a schematic view of an electronic keyboard instrument with wheels.

The waveform data time expanding and compressing device according to the present invention is not limited to the embodiment as stated earlier, and variations and modifications are of course possible without departing the sprit of the invention. For example, the control of the expansion and compression parameter R may be assigned to wheels 200 of the electronic keyboard instrument 20 shown in FIG. 11 so that the wheels can be properly turned or controlled during a musical performance to linearly change the expansion and compression of the reproducing time of a PCM waveform. This arrangement can provide new control of musical tones, expanding the extent of musical execution.

What is claimed is:

1. A waveform data time expanding and compressing device comprising:

a waveform memory for storing data of a PCM waveform;

a block address memory for storing addresses of respective blocks, the respective blocks having a length equal to a wavelength of a pitch as a trend of the PCM waveform or an integral multiple thereof;

a parameter determining unit for determining an expansion and compression parameter; and a waveform reproducer for carrying out waveform reproduction by determining a reading number for waveform data in a certain block in response to the expansion and compression parameter, sequentially reading out the block addresses according to the determined reading number, and reading out the PCM waveform data based on the block addresses thus read out.

2. The waveform data time expanding and compressing device according to claim 1, wherein the wavelength of the pitch as the trend of the PCM waveform is found by an autocorrelation function.

3. The waveform data time expanding and compressing device according to claim 1, wherein the respective blocks have a length between zero cross-points, which are apart from each other by a distance closest to that equal to the wavelength of the pitch as the trend of the PCM waveform or an integral multiple thereof.

4. The waveform data time expanding and compressing device according to claim 1, wherein the expansion and compression parameter set at the parameter determining unit is set so that the parameter is 1 for reproducing the PCM waveform as it is, the parameter is greater than 1 for reproducing the PCM waveform by a higher frequency, and the parameter is less than 1 for reproducing the PCM waveform by a lower frequency.

5. The waveform data time expanding and compressing device according to claim 1, wherein the waveform reproducer determines the reading number of the waveform data by making accumulation of the expansion and compression parameter in every reading of the addresses, setting the reading number at an integral part of an accumulation value given by the accumulation, setting the integral part at 0 after determination of the reading number, and repeating the accumulation.

6. The waveform data time expanding and compressing device according to claim 1, wherein the expansion and compression parameter set at the parameter determining unit is modified by a key scale parameter.

7. The waveform data time expanding and compressing device according to claim 1, wherein for reading out the waveform data at the waveform reproducer, sample data of certain points following a zero cross-point are inputted into a buffer after completion of reading out the waveform data in a block, and sample data of first certain points in a subsequent block and the sample data in the buffer are cross-faded in reading out the waveform in the latter block.

8. The waveform data time expanding and compressing device according to claim 1, wherein for reading out the waveform data at the waveform reproducer, sample data of certain points following a zero cross-point are inputted into a buffer after completion of reading out the waveform data in a block, and sample data of first certain points in a subsequent block and the sample data in the buffer are cross-faded in reading out the waveform in the latter block.

9. A waveform data time expanding and compressing device comprising:

a formant component memory for storing a formant component of data of an original PCM waveform;

a waveform memory for storing the PCM waveform data with the formant component removed;

a block address memory for storing addresses of respective blocks, the respective blocks having a length equal to a wavelength of a pitch as a trend of the PCM waveform or an integral multiple thereof;

a parameter determining unit for determining an expansion and compression parameter;

a waveform reproducer for carrying out waveform reproduction by determining a reading number for waveform data in a certain block in response to the expansion and compression parameter, sequentially reading out the block addresses according to the determined reading number, and reading out the PCM waveform data based on the block addresses thus read out; and a formant adder for adding a corresponding formant to the reproduced waveform.

10. The waveform data time expanding and compressing device according to claim 9, wherein the wavelength of the pitch as the trend of the PCM waveform is found by an autocorrelation function.

11. The waveform data time expanding and compressing device according to claim 9, wherein the respective blocks have a length between zero cross-points, which are apart each other by a distance closest to that equal to the wavelength of the pitch as the trend of the PCM waveform or an integral multiple thereof.

12. The waveform data time expanding and compressing device according to claim 9, wherein the expansion and compression parameter set at the parameter determining unit is set so that the parameter is 1 for reproducing the PCM waveform as it is, the parameter is greater than 1 for reproducing the PCM waveform by a higher frequency, and the parameter is less than 1 for reproducing the PCM waveform by a lower frequency.

13. The waveform data time expanding and compressing device according to claim 9, wherein the waveform reproducer determines the reading number of the waveform data by making accumulation of the expansion and compression parameter in every reading of the addresses, setting the reading number at an integral part of an accumulation value given by the accumulation, setting the integral part at 0 after determination of the reading number, and repeating the accumulation.

14. The waveform data time expanding and compressing device according to claim 9, wherein the expansion and compression parameter set at the parameter determining unit is modified by a key scale parameter.

* * * * *

UNITED STATES PATENT AND TRADEMARK OFFICE

CERTIFICATE OF CORRECTION

PATENT NO. : 6,300,552 B1
DATED : October 9, 2001
INVENTOR(S) : Sato

It is certified that error appears in the above-identified patent and that said Letters Patent is hereby corrected as shown below:

Title page,
Item [73], should read:
-- [73] Assignee: Kabushiki Kaisha Kawai Gakki Seisakusho, Hamamatsu -shi (JP) --

Signed and Sealed this

Twenty-sixth Day of March, 2002

*Attest:*

*Attesting Officer*

JAMES E. ROGAN
*Director of the United States Patent and Trademark Office*